US008851903B2

(12) United States Patent
Decker et al.

(10) Patent No.: US 8,851,903 B2
(45) Date of Patent: Oct. 7, 2014

(54) CONNECTOR ASSEMBLIES FOR CONNECTOR SYSTEMS

(71) Applicant: Tyco Electronics Corporation, Berwyn, PA (US)

(72) Inventors: Donald Francis Decker, Harrisburg, PA (US); George Irwin Peters, Jr., Harrisburg, PA (US); Matthew Edward Mostoller, Hummelstown, PA (US); Charles Raymond Gingrich, III, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 34 days.

(21) Appl. No.: 13/672,972

(22) Filed: Nov. 9, 2012

(65) Prior Publication Data

US 2014/0024230 A1 Jan. 23, 2014

Related U.S. Application Data

(63) Continuation-in-part of application No. 13/550,729, filed on Jul. 17, 2012.

(51) Int. Cl.

| | |
|---|---|
| ***H01R 13/66*** | (2006.01) |
| ***H01R 12/73*** | (2011.01) |
| ***H01R 12/75*** | (2011.01) |

(52) U.S. Cl.

CPC ..... *H01R 13/6658* (2013.01); *H01R 12/73* (2013.01); *H01R 12/75* (2013.01)

USPC ..... 439/65

(58) Field of Classification Search

USPC ..... 439/63, 65, 135, 83, 611, 60, 638, 441, 439/565, 578

See application file for complete search history.

(56) References Cited

U.S. PATENT DOCUMENTS

| | | | | |
|---|---|---|---|---|
| 3,818,280 | A * | 6/1974 | Smith et al. | 439/633 |
| 4,869,672 | A * | 9/1989 | Andrews, Jr. | 439/60 |
| 4,978,315 | A | 12/1990 | Edgley et al. | |
| 5,106,313 | A * | 4/1992 | Lwee et al. | 439/135 |
| 5,403,208 | A * | 4/1995 | Felcman et al. | 439/633 |

(Continued)

FOREIGN PATENT DOCUMENTS

| | | |
|---|---|---|
| EP | 2 139 079 A2 | 12/2009 |
| EP | 2 333 407 A1 | 6/2011 |

OTHER PUBLICATIONS

European Search Report, Mail Date Sep. 20, 2013, EP 13 17 6904, Application No. 13176904.4-1801.

*Primary Examiner* — Alexander Gilman

(57) ABSTRACT

A connector assembly includes a housing having a body and a head extending outward from the body. The housing is coupled to an LED circuit board with the head mounted to a front side of the LED circuit board and with the body extending through an opening of the LED circuit board to a rear side of the LED circuit board. The housing has driver card slot in the body configured to receive a driver card from the rear side of the LED circuit board. The housing has a contact channel open to the driver card slot with a contact therein. The contact has a mating interface configured to engage and be electrically connected to the driver card. The contact has a mounting leg extending from the head that is configured to be mounted to the front side of the LED circuit board.

20 Claims, 7 Drawing Sheets

(56) References Cited

U.S. PATENT DOCUMENTS

| | | | | |
|---|---|---|---|---|
| 5,494,456 | A | 2/1996 | Kozel et al. | |
| 5,586,008 | A * | 12/1996 | Kozel et al. | 361/743 |
| 5,746,611 | A * | 5/1998 | Brown et al. | 439/135 |
| 6,280,246 | B1 * | 8/2001 | Sawayanagi | 439/567 |
| 6,287,130 | B1 * | 9/2001 | Torii | 439/83 |
| 6,607,400 | B1 * | 8/2003 | Ko | 439/581 |
| 6,824,399 | B2 * | 11/2004 | Smith et al. | 439/82 |
| 7,074,054 | B2 * | 7/2006 | Mertz et al. | 439/78 |
| 7,175,469 | B1 * | 2/2007 | Daily et al. | 439/441 |
| 7,660,128 | B2 * | 2/2010 | Crews et al. | 361/761 |
| 7,704,082 | B2 * | 4/2010 | Daily et al. | 439/83 |
| 7,780,467 | B2 * | 8/2010 | Daily | 439/440 |
| 7,850,466 | B2 * | 12/2010 | Mostoller et al. | 439/83 |
| 7,892,031 | B1 * | 2/2011 | Mostoller et al. | 439/611 |
| 8,215,995 | B1 * | 7/2012 | Little et al. | 439/638 |
| 8,550,838 | B2 * | 10/2013 | Osagle et al. | 439/441 |
| 8,636,523 | B2 * | 1/2014 | Nagasaki et al. | 439/83 |
| 2006/0030207 | A1 | 2/2006 | Mertz et al. | |
| 2008/0153344 | A1 * | 6/2008 | Horst et al. | 439/427 |
| 2010/0068925 | A1 * | 3/2010 | Daily | 439/567 |

* cited by examiner

CONNECTOR ASSEMBLIES FOR CONNECTOR SYSTEMS

CROSS REFERENCE TO RELATED APPLICATIONS

This application is a continuation-in-part application and claims the benefit of U.S. patent application Ser. No. 13/550,729 filed Jul. 17, 2012, the subject matter of which is herein incorporated by reference in its entirety.

BACKGROUND OF THE INVENTION

The subject matter herein relates generally to connector assemblies for connector systems.

Many known connectors are mounted on a top side of a circuit board and protrude upward from the circuit board. These connectors include electrical contacts that are electrically connected to conductive traces in the circuit board or to wires that extend along the surface and/or sides of the circuit board. The connectors have a mating interface configured to mate with a mating connector. The mating interface typically is located parallel or perpendicular with respect to the top side of the circuit board.

These known connectors may have a height profile above the top side of the circuit board that is too large for certain applications. For example, the profile of many connectors used in conjunction with light emitting diodes ("LEDs") may be so large relative to the LEDs that the connectors impede or block some of the light emitted by the LEDs. Additionally, the trend towards smaller electronic devices and more densely packed electronic devices and connectors on a circuit board requires the reduction of the height profile for connectors.

A need exists for a connector having a smaller profile than known connectors. Such a connector may be useful in devices where a smaller connector height profile is desired, such as in LED lighting devices.

BRIEF DESCRIPTION OF THE INVENTION

In one embodiment, a connector assembly is provided for interconnecting an LED circuit board and a driver card supplying power to the LED circuit board. The connector assembly includes a housing having a body and a head extending outward from the body. The housing is coupled to the LED circuit board with the head mounted to a front side of the LED circuit board and with the body extending through an opening of the LED circuit board to a rear side of the LED circuit board. The housing has driver card slot in the body configured to receive the driver card therein in a loading direction from the rear side of the LED circuit board. The housing has a contact channel extending through the head and being open to the driver card slot. A contact is received in the contact channel. The contact has a mating interface configured to engage and be electrically connected to the driver card. The contact has a mounting leg extending from the head that is configured to be mounted to the front side of the LED circuit board.

In another embodiment, a connector system is provided including an LED circuit board having a front side, a rear side and an opening extending therethrough. The LED circuit board has a mounting pad on the front side and at least one LED mounted on the front side. The connector system includes a driver card having a power supply and a power pad proximate to a mating edge of the driver card. The connector system includes a connector assembly coupled to the LED circuit board and receiving the driver card to supply power from the driver card to the LED circuit board. The connector assembly includes a housing having a body and a head extending outward from the body. The housing is coupled to the LED circuit board with the head mounted to the front side of the LED circuit board and with the body extending through the opening of the LED circuit board to the rear side of the LED circuit board. The housing has a driver card slot in the body receiving the driver card therein in a loading direction from the rear side of the LED circuit board. The housing has a contact channel extending through the head that is open to the driver card slot. A contact is received in the contact channel. The contact has a mating interface configured to engage and be electrically connected to the power pad of the driver card. The contact has a mounting leg extending from the head that is terminated to the mounting pad on the front side of the LED circuit board.

In a further embodiment, a connector assembly is provided for mounting to a substrate having an opening extending between a front side and a rear side. The connector assembly includes a housing having a body at a bottom of the housing and a head at a top of the housing. The head extends from the body and is wider than the body and configured to be mounted to the front side of the substrate with the body extending through the opening of the substrate to the rear side of the substrate. The housing has a contact channel extending therethrough being open at the top and the bottom of the housing. A contact is received in the contact channel. The contact has a mating interface configured to engage and be electrically connected to a power conductor of a mating component loaded into the housing in a loading direction through the bottom of the housing from the rear side of the substrate. The contact has a mounting leg extending from the head that is configured to be mounted to the front side of the substrate.

DETAILED DESCRIPTION OF THE INVENTION

Figure 1:
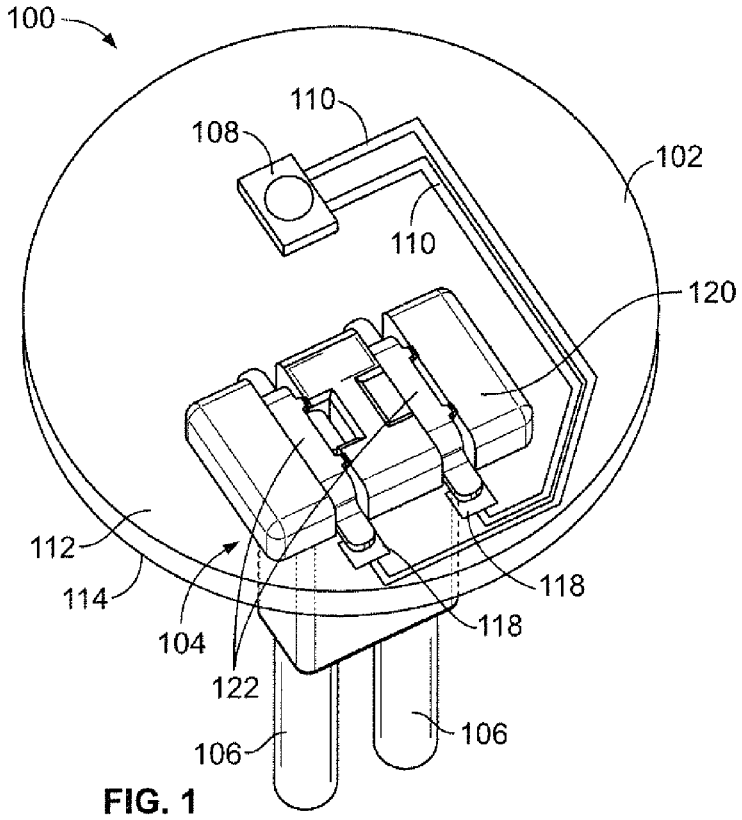
FIG. 1 is a front perspective view of a connector system formed in accordance with one embodiment.

FIG. 1 is a front perspective view of a connector system 100 formed in accordance with one embodiment. The connector system 100 includes a substrate 102 and a connector assembly 104 mounted to the substrate 102. A cable or wire 106 is directly terminated to the connector assembly 104. In an exemplary embodiment, the connector assembly 104 is a poke-in type of connector, where the wire 106 is coupled to the connector assembly 104 by a simple poke-in wire termination. The poke-in termination offers quick and reliable wire termination as a low-labor alternative to hand-soldering of the wire 106 either directly to the substrate 102 or to a contact or other component.

In an exemplary embodiment, the connector system 100 may be part of a lighting system, such as an LED lighting system. For example, one or more LEDs 108 may be mounted to the substrate 102 in the vicinity of the connector assembly 104. The substrate 102 may be referred to hereinafter as an LED circuit board 102. The connector assembly 104 may be electrically connected to the LEDs 108 by traces 110 on the substrate 102. The connector assembly 104 supplies power and/or control functions to the LEDs 108. The wire 106 supplies power to the connector assembly 104. The connector system 100 may have use in other fields or for other applications in alternative embodiments other than supplying power to LEDs.

The substrate 102 includes a front side 112 and a rear side 114. An opening 116 (shown in FIG. 5) extends through the substrate 102 between the front and rear sides 112, 114. The LEDs 108 and traces 110 are routed along the front side 112. The substrate 102 is a substantially flat supporting layer that may mechanically support the connector assembly 104 and may electrically connect the connector assembly 104 with one or more peripheral devices, including the LEDs 108 via the traces 110. In an exemplary embodiment, the substrate 102 may include a metal clad circuit board having an aluminum base or other metal base that provides very efficient thermal heat dissipation, such as for the LEDs 108. Other embodiments of the substrate 102 may be used in one or more alternative embodiments, such as an FR4 circuit board.

The connector assembly 104 is electrically connected to the substrate 102 at the front side 112, such as at mounting pads 118 on the front side 112. The connector assembly 104 extends through the opening 116 to the rear side 114. In the illustrated embodiment, the housing 120 at least partially protrudes through the opening 116 such that the bottom of the housing 120 is located proximate to and past the rear side 114 of the substrate 102. In another embodiment, the bottom of the housing 120 is substantially flush with the rear side 114 of the substrate 102. In another embodiment, the bottom of the housing 120 is partially recessed in the opening 116.

The wire 106 is terminated to the connector assembly 104 at the rear side 114. For example, the wire 106 may be loaded into the connector assembly 104 through the rear side 114. Such a system allows the wire 106 to remain in the fixture or recessed can that holds the connector system 100, which makes for easier, more direct termination by reducing routing of the wire 106. Such a system keeps the wire 106 on the rear side 114 of the substrate 102. The wire 106 does not need to be routed to the front side 112 to make an electrical connection to the substrate 102 or a connector on the front side 112. The wire 106 is thus not routed near the LEDs 108. The wire 106 does not block the light produced by the LEDs 108. The connector assembly 104 has a low profile so as to not detrimentally affect the lighting pattern of the LEDs 108. The profile of the connector assembly 104 is controllable, as compared to, for example, random routing of the wire 106 along the front side 112.

The connector assembly 104 includes a housing 120 and one or more poke-in contacts 122. In the illustrated embodiment, the connector assembly 104 includes two poke-in contacts 122, however any number of poke-in contacts 122 may be utilized. The poke-in contacts 122 are mounted to the front side 112 of the substrate 102 and the poke-in contacts 122 receive corresponding wires 106 from the rear side 114 of the substrate 102. The housing 120 extends through the opening 116 in the substrate 102, positioning the housing 120 on both sides 112, 114 of the substrate 102. Having the housing 120 extending through the substrate 102 allows the termination of the poke-in contacts 122 on the front side 112 while still allowing the termination to the wires 106 on the rear side 114.

In an exemplary embodiment, the connector system 100 is arranged such that the substrate 102 is oriented generally horizontally with the housing 120 extending generally vertically through the substrate 102. The front side 112 is positioned generally vertically above the rear side 114. The LEDs 108 are positioned on the top and the wire 106 is loaded into the connector assembly 104 from the bottom. The wire loading direction is oriented generally vertically. Such orientation is merely one example of a possible orientation, but it is realized that other orientations are possible, including an orientation that was rotated 180° with the LEDs 108 positioned on the bottom, an orientation that was rotated 90° with the substrate 102 oriented vertically, or other orientations. The description herein will be with reference to an orientation with the substrate 102 being horizontal and the LEDs 108 on the top.

Figure 2:
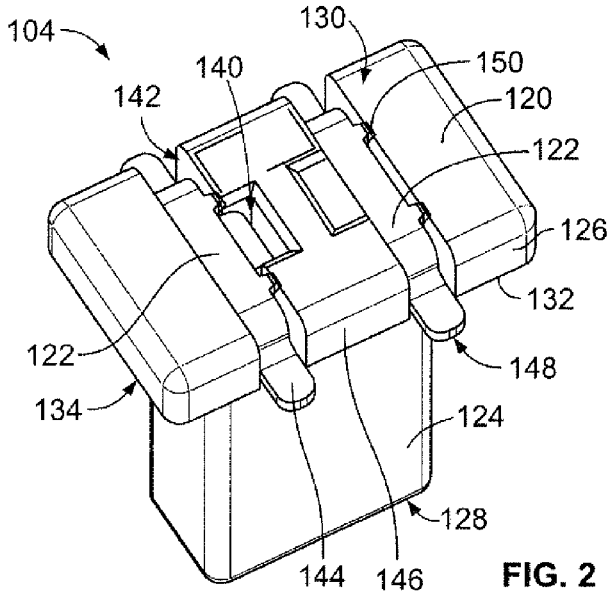
FIG. 2 is a top perspective view of a connector assembly for the connector system.
Figure 3:
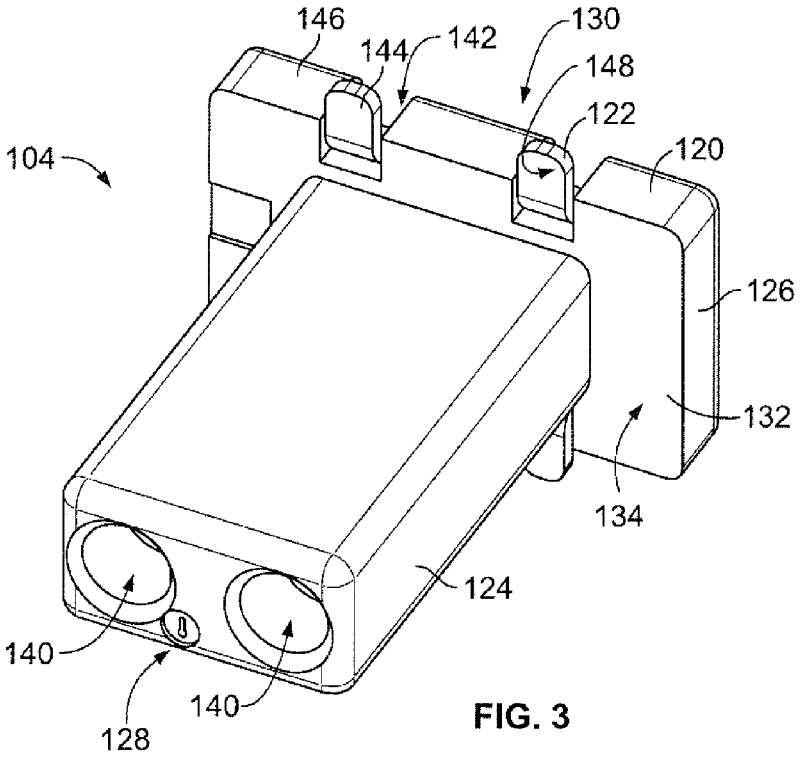
FIG. 3 is a bottom perspective view of the connector assembly.

FIG. 2 is a top perspective view of the connector assembly 104. FIG. 3 is a bottom perspective view of the connector assembly 104. The housing 120 includes a body 124 and a head 126. The body 124 extends from the head 126 to a bottom 128 of the housing 120. A top 130 of the housing 120 is defined by the head 126 generally opposite to the body 124. The head 126 is wider than the body 124 in at least one dimension (e.g. longitudinally and/or laterally). The body 124 is sized to extend through the opening 116 in the substrate 102 (both shown in FIG. 1). The head 126 is sized larger than the opening 116 and is configured to be seated against the front side 112 (shown in FIG. 1) of the substrate 102 when the body 124 is loaded into the opening 116. The head 126 may limit how far the housing 120 may be inserted into the opening 116. In an exemplary embodiment, the housing 120 includes and/or is formed from a dielectric material, such as a plastic material.

The head 126 includes a ledge 132 along a head bottom 134, which is defined by the bottom surface of the head 126 generally opposite the top 130. The ledge 132 extends to the body 124. The ledge 132 is downward facing and is configured to face and/or abut against the front side 112. The ledge 132 faces the bottom 128 of the housing 120.

The housing 120 includes contact channels 140 extending therethrough that receive the poke-in contacts 122. In an exemplary embodiment, the contact channels 140 extend entirely through the housing 120 and are open at the top 130 and the bottom 128. The contact channels 140 receive the poke-in contacts 122 through the top 130. The contact channels 140 receive the wires 106 (shown in FIG. 1) through the bottom 128. The contact channels 140 are sized and shaped to hold the poke-in contacts 122. The contact channels 140 are sized and shaped to receive and guide the wires 106 to the poke-in contacts 122.

The housing 120 includes contact slots 142 at the top 130. The contact slots 142 receive portions of the poke-in contacts 122. In an exemplary embodiment, the poke-in contacts 122 have one or more mounting legs 144. The mounting legs 144 are used to mechanically and electrically couple the poke-in contacts 122 to the substrate 102. For example, the mounting legs 144 may be soldered to the substrate 102. The contact slots 142 receive the mounting legs 144. The contact slots 142 extend from the contact channels 140 to outer edges 146 of the housing 120. The contact slots 142 allow the mounting legs 144 to be routed from the contact channels 140 to the outer edges 146. The mounting legs 144 have mounting surfaces 148 that are oriented for termination to the corresponding mounting pads 118. In an exemplary embodiment, the mounting surfaces 148 are oriented generally coplanar with the ledge 132 at the head bottom 134 for mounting to the front side 112 of the substrate 102. The mounting surfaces 148 face the bottom 128 of the housing 120.

In an exemplary embodiment, the poke-in contacts 122 have locking barbs 150 extending therefrom that dig into the housing 120 within the contact slots 142 to hold the poke-in contacts 122 in the contact slots 142. The locking barbs 150 provide holding force to hold the poke-in contacts 122 in the contact slots 142 during mounting of the connector assembly 104 to the substrate 102. The locking barbs 150 provide holding force to hold the poke-in contacts 122 in the contact slots 142 during insertion of the wire 106 into the contact channels 140. Other types of securing features may be used in alternative embodiments to hold the poke-in contacts 122 in the housing 120.

Figure 4:
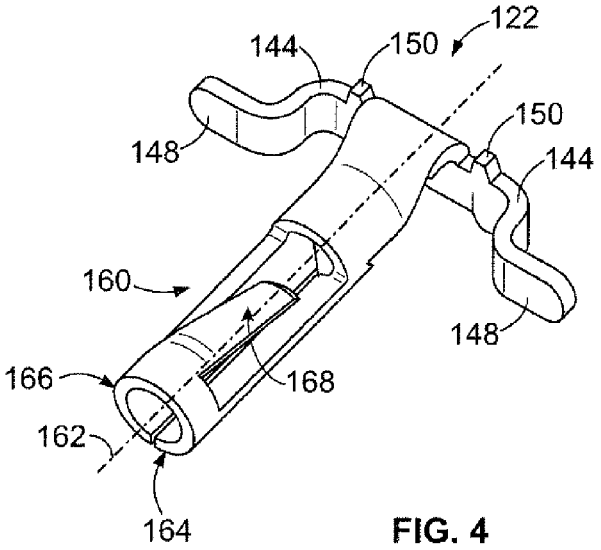
FIG. 4 is a bottom perspective view of a poke-in contact for the connector assembly.

FIG. 4 is a bottom perspective view of the poke-in contact 122. The poke-in contact 122 includes a wire trap 160 configured to receive the wire 106 (shown in FIG. 1) to electrically connect the poke-in contact 122 to the wire 106. A pair of mounting legs 144 extends from the wire trap 160 at a top of the poke-in contact 122. Any number of mounting legs 144 may be provided, including a single mounting leg 144. The locking barbs 150 extend from the mounting legs 144 at the top. The locking barbs 150 may be provided at different locations in alternative embodiments.

The wire trap 160 generally extends along a longitudinal axis 162 from the mounting legs 144 at the top to a wire receiving end 164 at a bottom of the wire trap 160. The wire trap 160 includes a barrel 166 configured to receive the wire 106 therein. The wire trap 160 includes a spring finger 168 extending into the barrel 166 to engage the wire 106 when the wire 106 is loaded into the barrel 166. The spring finger 168 is held against the wire 106 by a spring force to ensure electrical contact with the wire 106. Optionally, multiple spring fingers 168 may extend into the barrel 166 to engage different sides of the wire 106. The end of the spring finger 168 may dig into the wire 106 to resist pull out of the wire 106. In an exemplary embodiment, the poke-in contact 122 is stamped and formed. The barrel 166 is shaped by bending two edges of the poke-in contact 122 into a barrel shape to meet at a seam. Optionally, the spring finger 168 may be generally opposite the seam. The spring finger 168 is stamped out of the poke-in contact 122 and bent inward into the barrel 166.

The mounting legs 144 are bent or shaped such that the mounting surfaces 148 are oriented along a plane generally perpendicular to the longitudinal axis 162. The mounting legs 144 may define spring legs that are configured to be held against the substrate 102 by a spring force. Optionally, the mounting legs 144 may be slightly angled downward, such that the mounting legs 144 are deflected upward when mounted to the substrate 102.

Figure 5:
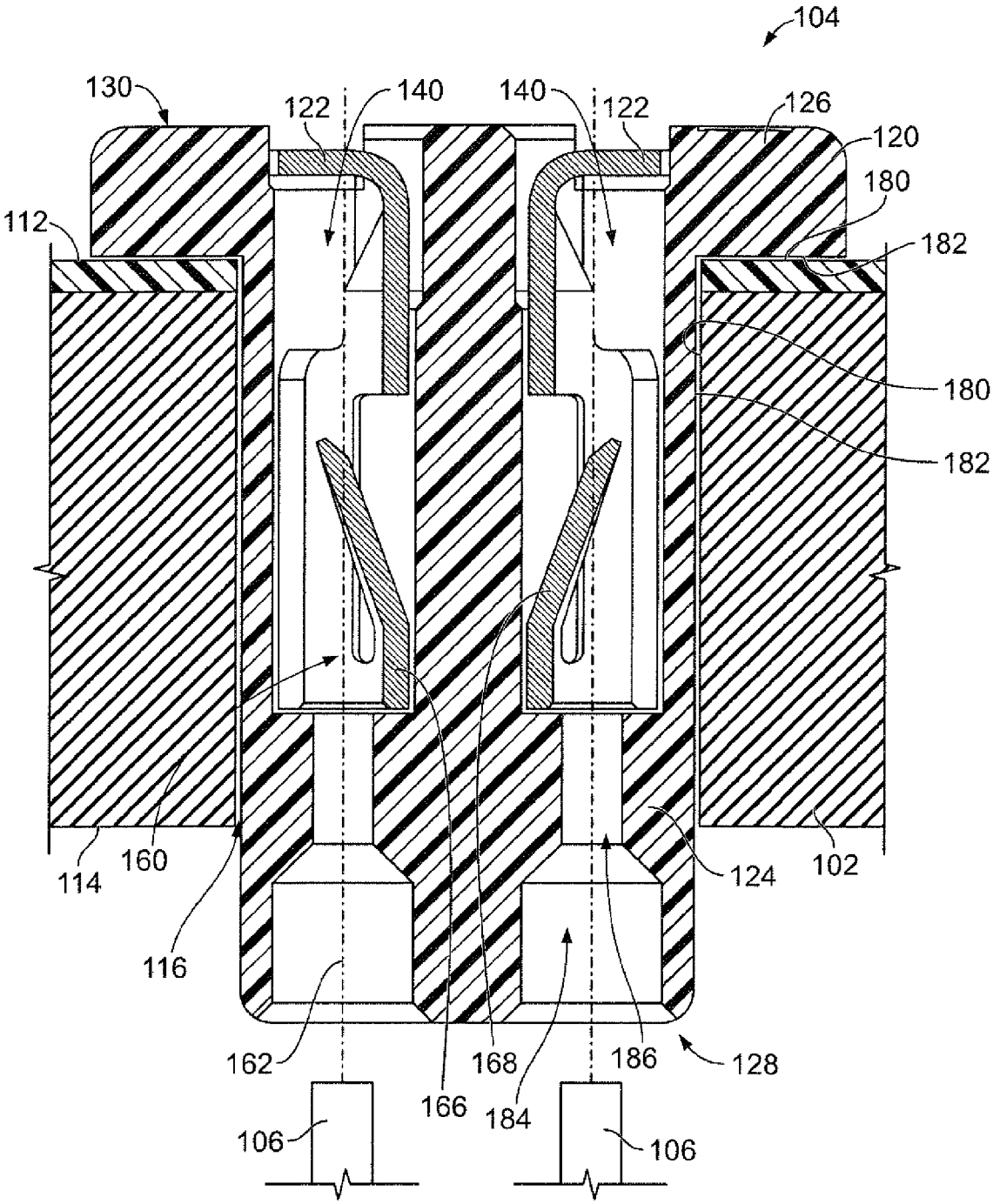
FIG. 5 is a cross-sectional view of the connector assembly.

FIG. 5 is a cross-sectional view of the connector assembly 104. The poke-in contacts 122 are loaded into the contact channels 140. In an exemplary embodiment, the poke-in contacts 122 are loaded into the contact channels 140 through the top 130. The mounting legs 144 extend along the head 126. The wire traps 160 are loaded into the contact channels 140 and are located in the body 124.

The substrate 102 is illustrated in FIG. 5, showing the connector assembly 104 loaded through the opening 116. The opening 116 is defined by walls 180 of the substrate 102. The housing 120 includes substrate engagement surfaces 182 that engage the substrate 102. The substrate engagement surfaces 182 extend along the body 124. The body 124 is generally positioned within the plane of the substrate 102, but may extend beyond the rear side 114. In an exemplary embodiment, the wire traps 160, when loaded into the body 124 are aligned with the plane of the substrate 102 (e.g. vertically aligned). For example, the barrels 166 and spring fingers 168 are positioned between the front and rear sides 112, 114. In alternative embodiments, the wire traps 160 may only be partially aligned with the plane of the substrate 102, with a portion of the wire traps 160 extending beyond the rear side 114. In other alternative embodiments, the wire traps 160 may not be aligned with the substrate 102, but rather the entire wire traps 160 are positioned beyond the rear side 114.

The contact channels 140 are sized and shaped to guide the wires 106 into the wire traps 160. At the bottom 128, the contact channels 140 include funnels 184 that receive the wires 106 and guide the wires 106 into ports 186 that are generally centered along the contact channels 140. The ports 186 may have smaller diameters than other portions of the contact channels 140 to locate the wires 106 along the longitudinal axes 162 of the poke-in contacts 122. The ports 186 position the wires 106 to ensure that the wires 106 will engage the spring fingers 168 when pushed into the connector assembly 104. The ports 186 may have diameters that are approximately equal to the diameters of the wires 106 such that the wires 106 are somewhat restricted from movement (e.g. side-to-side) within the connector assembly 104.

A connector assembly 104 is provided that is inverted such that the connector assembly 104 extends through the substrate 102. The connector assembly 104 is thus mounted to the front side 112 but yet is also accessible at the rear side 114 for termination to the wire 106. The connector assembly 104 utilizes the poke-in contacts 122 for quick termination of the wire 106 to the connector assembly 104. The wire 106 remains on the rear side 114 of the substrate 102 and does not block other components on the front side 112, such as the lighting pattern of the LEDs 108 on the front side 112.

Figure 6:
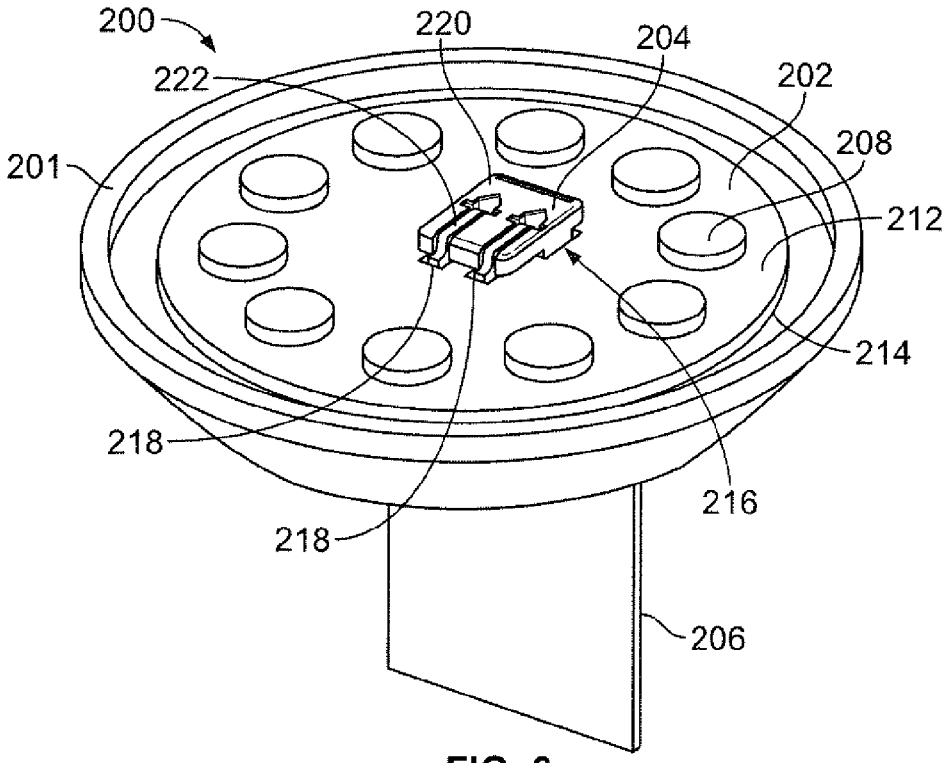
FIG. 6 is a top perspective view of a connector system formed in accordance with one embodiment.
Figure 7:
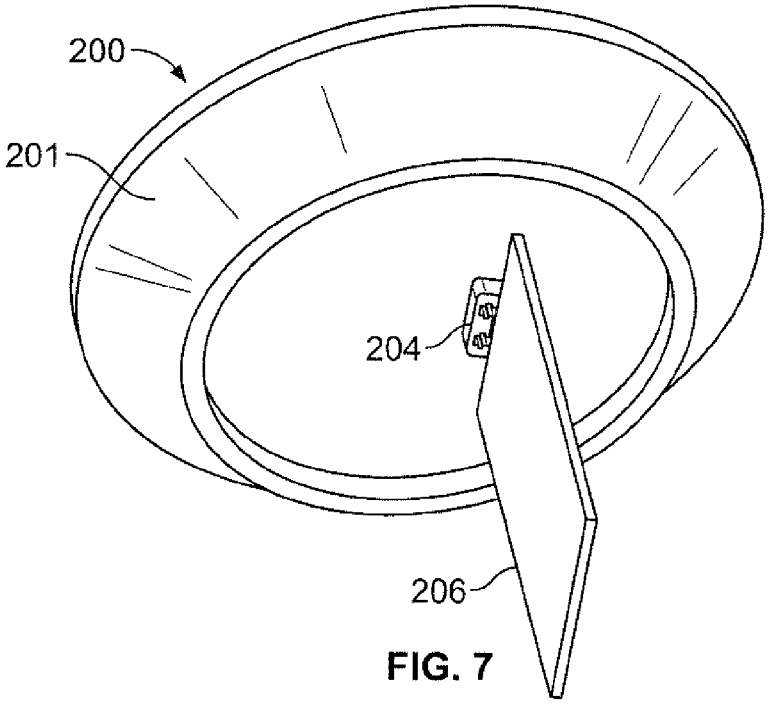
FIG. 7 is a bottom perspective view of the connector system shown in FIG. 6.

FIG. 6 is a top perspective view of a connector system 200 formed in accordance with one embodiment. FIG. 7 is a bottom perspective view of the connector system 200. The connector system 200 is another example of a connector system and is similar to the connector system 100 (shown in FIG. 1) and may include similar components.

The connector system 200 includes a heat sink 201, a substrate 202 mounted to the heat sink 201 and a connector assembly 204 mounted to the substrate 202. A driver card 206 is directly terminated to the connector assembly 204 to supply power to the substrate 202. In an exemplary embodiment, the connector assembly 204 is a card edge type of connector, where an edge of the driver card 206 is plugged directly into the connector assembly 204, which may define a separable mating interface. The card edge termination offers quick and reliable power termination, which may be accomplished by an automated process and as a low-labor alternative to hand-soldering of wires directly to the substrate 202 or to a contact or other component of the substrate 202.

In an exemplary embodiment, the connector system 200 may be part of a lighting system, such as an LED lighting system. For example, the substrate 202 may be an LED circuit board with one or more LEDs 208 mounted to the LED circuit board. The substrate 202 may be referred to hereinafter as an LED circuit board. The connector assembly 204 supplies power and/or control functions to the LEDs 208. The driver card 206 supplies power to the connector assembly 204. The connector system 200 may have use in other fields or for other applications in alternative embodiments other than supplying power to LEDs. The heat sink 201 dissipates heat from the components mounted to the LED circuit board 202, such as the LEDs 208.

The LED circuit board 202 includes a front side 212 and a rear side 214. In the orientation shown in FIG. 6, the front side 212 defines a top and the rear side 214 defines a bottom. While components described herein may be referred to as top or bottom, such labels are merely descriptive of the orientation shown in FIG. 6 and the system may be utilized (e.g. mounted in a fixture) with a component referred to as "top" positioned vertically below a component referred to as "bottom", and vice versa.

An opening 216 (shown in FIG. 6) extends through the LED circuit board 202 between the front and rear sides 212, 214. The LEDs 208 and corresponding traces are routed along the front side 212. The LED circuit board 202 is a substantially flat supporting layer that may mechanically support the connector assembly 204 and may electrically connect the connector assembly 204 with one or more peripheral devices, including the LEDs 208. In an exemplary embodiment, the LED circuit board 202 may include a metal clad circuit board having an aluminum base or other metal base that provides very efficient thermal heat dissipation, such as for the LEDs 208, to the heat sink 201. Other embodiments of the LED circuit board 202 may be used in one or more alternative embodiments, such as an FR4 circuit board.

The connector assembly 204 is electrically connected to the LED circuit board 202 at the front side 212, such as at mounting pads 218 on the front side 212. Optionally, a cover or cap may be provided and secured over the top of the connector assembly 204, such as to cover the contacts 222. The cover may be coupled to the head of the housing 220. The cover may be latched to the housing 220. The cover may cover the exposed portions of the contacts 222 to limit unintentional touching of the contacts 222. The connector assembly 204 extends through the opening 216 to the rear side 214. In the illustrated embodiment, the housing 220 at least partially protrudes through the opening 216 such that the bottom of the housing 220 is located proximate to and past the rear side 214 of the LED circuit board 202 and at or past a rear side of the heat sink 201. In another embodiment, the bottom of the housing 220 is substantially flush with the rear side 214 of the LED circuit board 202 or the rear side of the heat sink 201. In another embodiment, the bottom of the housing 220 is partially recessed in the opening 216 or in the heat sink 201.

The driver card 206 is terminated to the connector assembly 204 from the rear side 214. For example, the driver card 206 may be loaded into the connector assembly 204 from underneath the heat sink 201 and the LED circuit board 202. Such a system allows the driver card 206 to remain in the fixture or recessed can that holds the connector system 200, which makes for easier, more direct termination by reducing routing of wire or other components to the front side 212 of the LED circuit board 202. Such a system keeps the driver card, wires and other components on the rear side 214 of the LED circuit board 202. Wires do not need to be routed from the driver card 206 to the front side 212 to make an electrical connection to the LED circuit board 202 or a connector on the front side 212. Wires and other components are thus not routed or positioned near the LEDs 208. The light produced by the LEDs 208 is not blocked by other components or wires. The connector assembly 204 has a low profile so as to not detrimentally affect the lighting pattern of the LEDs 208. The profile of the connector assembly 204 is controllable and fixed in space by design, as compared to, for example, random routing of the wires along the front side 212.

The connector assembly 204 includes a housing 220 and one or more contacts 222. In the illustrated embodiment, the connector assembly 204 includes two contacts 222, however any number of contacts 222 may be utilized. The contacts 222 are mounted to the front side 212 of the LED circuit board 202 and the contacts 222 mate with the driver card 206. The housing 220 extends through the opening 216 in the LED circuit board 202, positioning the housing 220 on both sides 212, 214 of the LED circuit board 202. Having the housing 220 extending through the LED circuit board 202 allows the termination of the contacts 222 on the front side 212 while still allowing the power termination on the rear side 214.

In an exemplary embodiment, the connector system 200 is arranged such that the LED circuit board 202 is oriented generally horizontally with the driver card 206 extending generally vertically from the connector assembly 204. The front side 212 is positioned generally vertically above the rear side 214. The LEDs 208 are positioned on the top and the driver card 206 is loaded into the connector assembly 204 from the bottom. The wire loading direction is oriented generally vertically. Such orientation is merely one example of a possible orientation, but it is realized that other orientations are possible, including an orientation that is rotated 180° with the LEDs 208 positioned on the bottom, an orientation that is rotated 90° with the LED circuit board 202 oriented vertically, or other orientations. The description herein will be with reference to an orientation with the LED circuit board 202 being horizontal and the LEDs 208 on the top.

Figure 8:
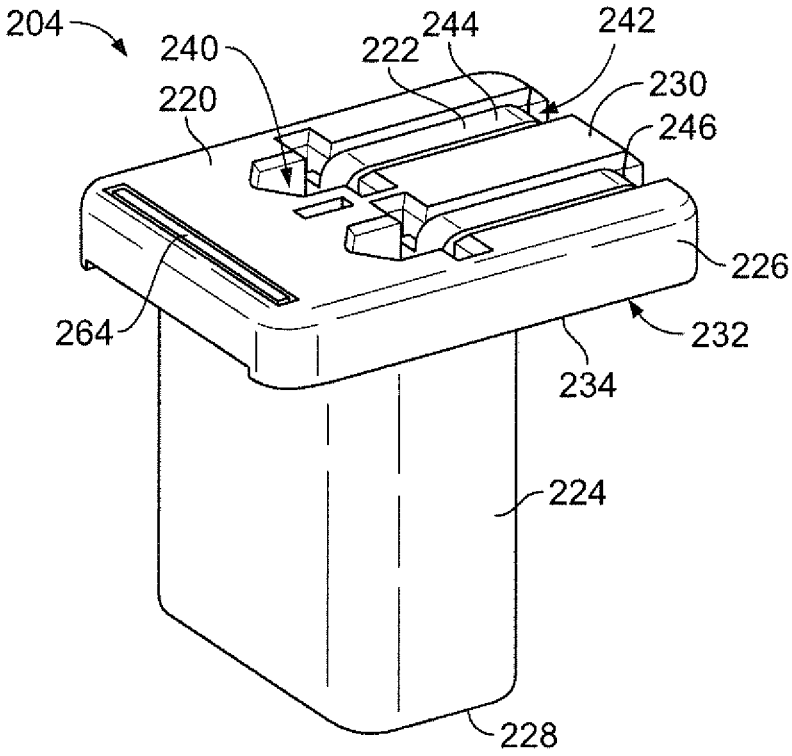
FIG. 8 is a top perspective view of a connector assembly of the connector system shown in FIG. 6.
Figure 9:
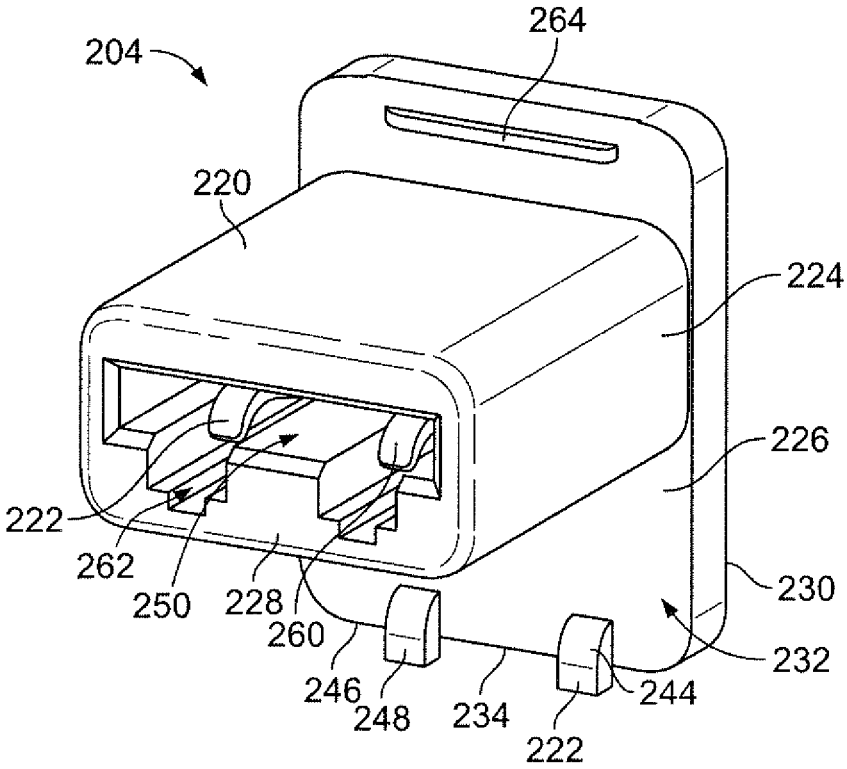
FIG. 9 is a bottom perspective view of the connector assembly shown in FIG. 8.

FIG. 8 is a top perspective view of the connector assembly 204. FIG. 9 is a bottom perspective view of the connector assembly 204. The housing 220 includes a body 224 and a head 226. The body 224 extends from the head 226 to a bottom 228 of the housing 220. A top 230 of the housing 220 is defined by the head 226 generally opposite to the body 224. The head 226 is wider than the body 224 in at least one dimension (e.g. longitudinally and/or laterally). The body 224 is sized to extend through the opening 216 in the LED circuit board 202 (both shown in FIG. 6). The head 226 is sized larger than the opening 216 and is configured to be seated against the front side 212 (shown in FIG. 6) of the LED circuit board 202 when the body 224 is loaded into the opening 216. The head 226 may limit how far the housing 220 may be inserted into the opening 216. In an exemplary embodiment, the housing 220 includes and/or is formed from a dielectric material, such as a plastic material.

The head 226 includes a ledge 232 along a head bottom 234, which is defined by the bottom surface of the head 226 generally opposite the top 230. The ledge 232 extends to the body 224. The ledge 232 is downward facing and is configured to face and/or abut against the front side 212. The ledge 232 faces the bottom 228 of the housing 220.

The housing 220 includes contact channels 240 extending therethrough that receive the contacts 222. In an exemplary embodiment, the contact channels 240 extend entirely through the housing 220 and are open at the top 230 and the bottom 228. The contact channels 240 receive the contacts 222 through the top 230. The contact channels 240 are sized and shaped to hold the contacts 222. The contact channels 240 are open to a driver card slot 250 at the bottom 228. The driver card slot 250 is sized and shaped to receive the driver card 206 (shown in FIG. 2) therein. Any number of contacts 222 and contact channels 240 may be provided.

The housing 220 includes contact slots 242 at the top 230. The contact slots 242 receive portions of the contacts 222. In an exemplary embodiment, the contacts 222 have one or more mounting legs 244. The mounting legs 244 are used to mechanically and electrically couple the contacts 222 to the LED circuit board 202. For example, the mounting legs 244 may be soldered to the LED circuit board 202. The contact slots 242 receive the mounting legs 244. The contact slots 242 extend from the contact channels 240 to an outer edge 246 of the housing 220. In the illustrated embodiment, the contact slots 242 extend in the same direction such that the mounting legs 244 extend to the same edge 246 of the housing 220.

The mounting legs 244 have mounting surfaces 248 that are oriented for termination to the corresponding mounting pads 218. In an exemplary embodiment, the mounting surfaces 248 are oriented generally coplanar with the ledge 232 at the head bottom 234 for mounting to the front side 212 of the LED circuit board 202. The mounting surfaces 248 face the bottom 228 of the housing 220.

Each contact 222 includes a spring beam 260 opposite the mounting leg 244. The spring beam 260 is configured to be spring biased against the driver card 206 (shown in FIG. 6) when the driver card 206 is loaded into the driver card slot 250 to electrically connect the contact 222 to the driver card 206. The spring beam 260 forms a separable mating interface with the driver card 206. The spring beams 260 are deflectable in the driver card slot 250. The housing 220 may include pockets 262 that allow the spring beams 260 to deflect outward when the driver card 206 is loaded into the driver card slot 250.

In an exemplary embodiment, the housing 220 holds a hold down tab 264 in the head 226. The hold down tab 264 is exposed along the head bottom 234 for securing the connector assembly 204 to the LED circuit board 202. In an exemplary embodiment, the hold down tab 264 is configured to be soldered to the LED circuit board 202 to secure the connector assembly 204 to the LED circuit board 202. Any number of hold down tabs 264 may be provided. Other types of securing features may be used in alternative embodiments to secure the connector assembly 204 to the LED circuit board 202.

Figure 10:
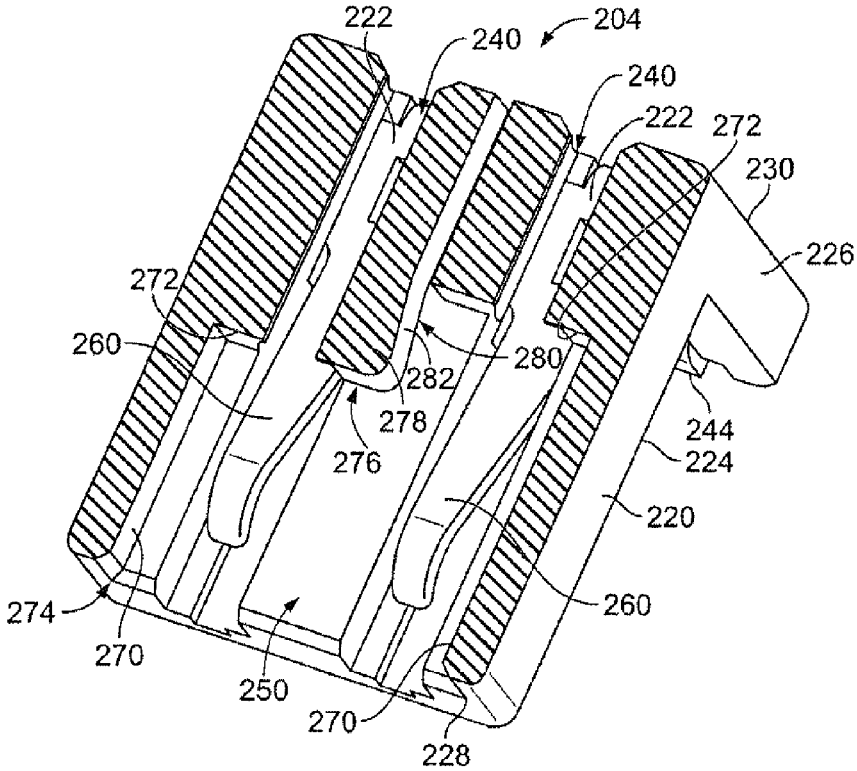
FIG. 10 is a cross-sectional view of the connector assembly shown in FIG. 8.

FIG. 10 is a cross-sectional view of the connector assembly 204. The contacts 222 are loaded into the contact channels 240. In an exemplary embodiment, the contacts 222 are loaded into the contact channels 240 through the top 230. The mounting legs 244 extend along the head 226. The spring beams 260 are loaded into the contact channels 240 and are located in the driver card slot 250 in the body 224.

The driver card slot 250 is defined by side walls 270 and an inner wall 272 opposite an opening 274 in the bottom 228 of the housing 220, through which the driver card 206 (shown in FIG. 6) is loaded into the driver card slot 250. The contact channels 240 are open to the driver card slot 250 allowing the contacts 222 to extend into the driver card slot 250 from the contact channels 240.

In an exemplary embodiment, the housing 220 includes a polarization feature 276 in the driver card slot 250. The polarization feature 276 is defined by a non-uniform shape of the driver card slot 250. For example, the inner wall 272 is not straight, but rather has a portion that is offset and further recessed from the bottom 228. Having a portion of the driver card slot 250 stepped inward allows the driver card 206 to be inserted in a single orientation. The step back in the driver card slot 250 exposes more of one of the contacts 222 as compared to the other contact 222. A greater length of one of the contacts 222 is exposed in the driver card slot 250 as compared to the length that the other contact 222 is exposed.

In an exemplary embodiment, the housing 220 includes a latch 278 in the driver card slot 250. The latch 278 is used to secure the driver card 206 in the driver card slot 250. The latch 278 is defined by an undercut 280 extending between the offset portions of the inner wall 272. The undercut 280 has a slant surface 282 that is angled transverse to the loading direction. A portion of the driver card 206 is configured to be captured in the undercut 280 by the slant surface 282. The nose of the latch 278 may be rounded to allow for easier insertion of the driver card 206 into the driver card slot 250. Other types of securing features may be used other than a latch.

Figure 11:
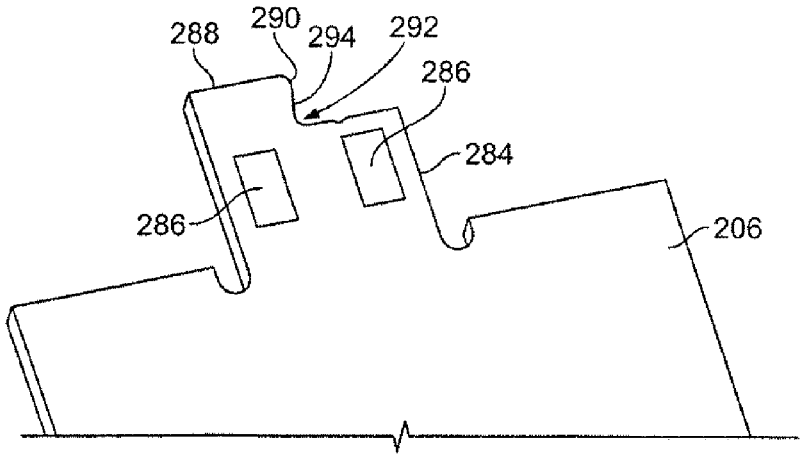
FIG. 11 illustrates a portion of a driver card of the connector system shown in FIG. 6.

FIG. 11 illustrates a portion of the driver card 206. The driver card 206 includes a mating extension 284 configured to be plugged into the driver card slot 250 (shown in FIG. 10). The driver card 206 includes power pads 286 on the mating extension 284. The power pads 286 are configured to be mated with the contacts 222 (shown in FIG. 10) when the driver card 206 is loaded into the driver card slot 250. Optionally, the power pads 286 may be staggered (e.g. one of the power pads 286 may be positioned closer to a front edge 288 of the driver card 206) to allow for sequenced mating with the contacts 222.

The driver card 206 includes a latch 290 for securing the driver card 206 in the driver card slot 250. The latch 290 is defined by an undercut 292 defined by a staggered front edge 288. The undercut 292 has a slant surface 294 that is angled transverse to the loading direction of the driver card 206. The latch 290 is configured to be captured in the undercut 280 (shown in FIG. 10) when the driver card 206 is loaded in the driver card slot 250. The nose of the latch 290 may be rounded to allow for easier insertion of the driver card 206 into the driver card slot 250. Other types of securing features may be used other than a latch.

Figure 12:
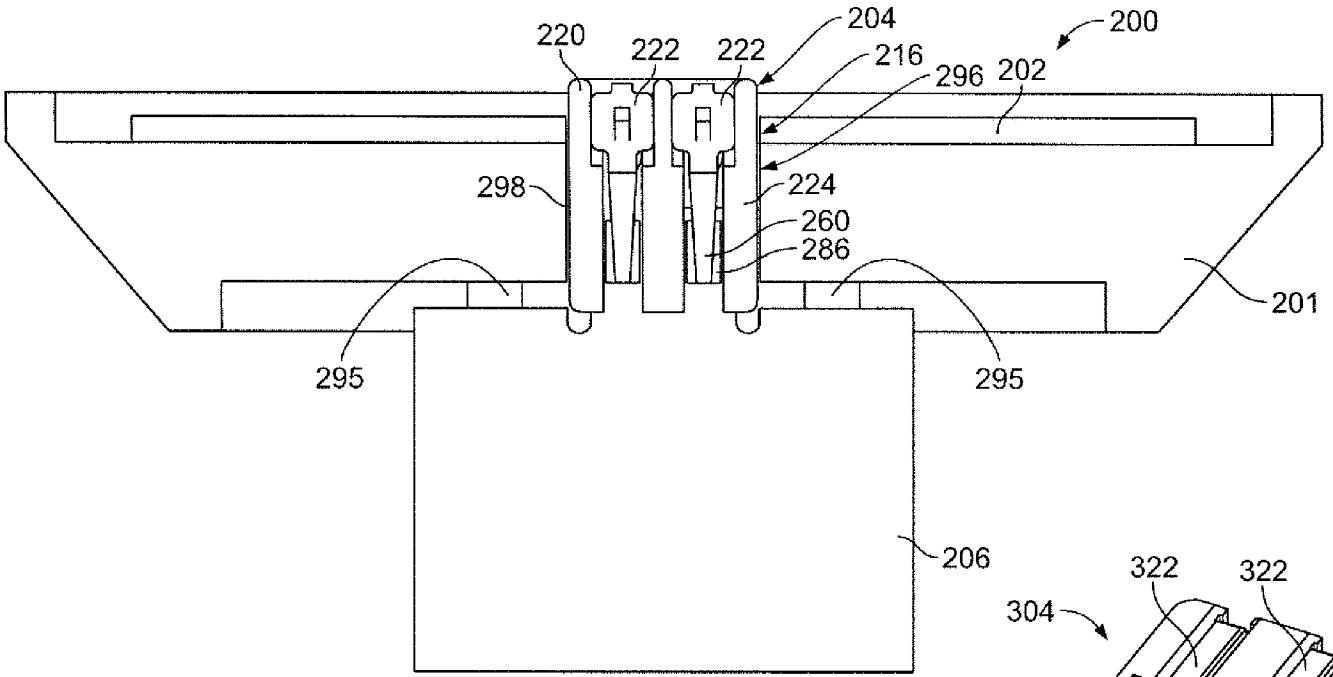
FIG. 12 is a cross-sectional view of the connector system showing the driver card loaded into the connector assembly.

FIG. 12 is a cross-sectional view of the connector system 200, showing the driver card 206 loaded into the connector assembly 204. The contacts 222 engage the power pads 286 to create a power path from the driver card 206 to the LED circuit board 202.

Optionally, stops 295 may be provided to limit insertion of the driver card 206 into the connector assembly 204, such as to ensure that the connector assembly 204 is not pushed off of the LED circuit board 202 during mating. The stops 295 may be positioned between the driver card 206 and the bottom of the heat sink 201. Optionally, the stops 295 may be part of the driver card 206, such as defined by the board of the driver card 206 or separate components mounted to the driver card 206. Alternatively, the stops 295 may be part of the heat sink 201 or coupled to the heat sink 201.

The connector assembly 204 is shown loaded through the opening 216 in the LED circuit board 202 and loaded through an opening 296 in the heat sink 201. The openings 216, 296 are defined by internal walls. The housing 220 includes engagement surfaces 298 that engage the LED circuit board 202 and the heat sink 201 along the internal walls of the openings 216, 296. The engagement surfaces 298 extend along the body 224. The body 224 is generally positioned within the plane of the LED circuit board 202 and the heat sink 201, and may extend beyond the bottoms thereof. In an exemplary embodiment, the spring beams 260, when loaded into the body 224, are aligned with the plane of the LED circuit board 202 and the plane of the heat sink 201 (e.g. vertically aligned).

Figure 13:
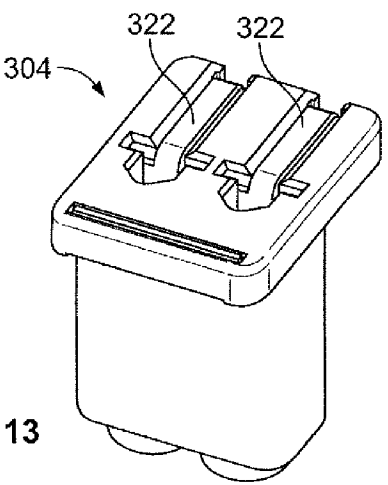
FIG. 13 illustrate a connector assembly formed in accordance with an exemplary embodiment.

FIG. 13 illustrate another connector assembly 304 formed in accordance with an exemplary embodiment. The connector assembly 304 is similar to the connector assembly 204 (shown in FIG. 6), however the connector assembly 304 is configured to be terminated directly to wires. For example, the connector assembly 304 includes contacts 322 that are poke-in type contacts (similar to the poke-in type contacts 122 of FIG. 1) that have wire barrels that receive ends of wires therein. Any number of contacts 322 may be used. The connector assembly 304 may have similar dimensions and mounting features as the connector assembly 204 for mounting to the LED circuit board 202 (shown in FIG. 6). For example, the mounting legs of the contacts 322 may be identical to the mounting legs of the contacts 222 (shown in FIG. 6).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly for interconnecting an LED circuit board and a driver card supplying power to the LED circuit board, the connector assembly comprising:

a housing having a body and a head extending outward from the body, the housing being coupled to the LED circuit board with the head mounted to a front side of the LED circuit board and with the body extending through an opening of the LED circuit board to a rear side of the LED circuit board, the housing having a driver card slot in the body, the driver card slot having a driver card slot opening configured to receive the driver card therein in a loading direction from the rear side of the LED circuit board, the driver card slot having an inner wall opposite the driver card slot opening and side walls that extend between the driver card slot opening and the inner wall, and the housing having a contact channel extending through the head and being open to the driver card slot at the inner wall, wherein the housing includes an undercut in the inner wall defining a latch in the driver card slot remote from the driver card slot opening, the undercut having a slant surface being angled transverse to the loading direction, the slant surface being configured to engage the driver card to retain the driver card in the driver card slot; and a contact received in the contact channel, the contact having a mating interface configured to engage and be electrically connected to the driver card, the contact having a mounting leg extending from the head and being configured to be mounted to the front side of the LED circuit board.

2. The connector assembly of claim 1, wherein the body is provided at a bottom of the housing, the head is provided at a top of the housing, the mounting leg having a mounting surface configured to be mounted to the front side of the LED circuit board, the mounting surface facing the bottom of the housing.

3. The connector assembly of claim 1, wherein the body is provided at a bottom of the housing, the head is provided at a top of the housing, the head including a ledge facing the bottom of the housing, the ledge being configured to face the front side of the LED circuit board.

4. The connector assembly of claim 1, wherein the body includes an outer surface engaging the LED circuit board in the opening where the body passes through the LED circuit board.

5. The connector assembly of claim 1, wherein the contact includes a spring beam in the driver card slot defining the mating interface, the spring beam being spring biased against the driver card when the driver card is loaded into the driver card slot.

6. The connector assembly of claim 1, wherein the housing includes a contact slot open along a top of the housing, the contact slot being open to the contact channel, the contact being received in the contact channel such that the mounting leg is received in and extends through the contact slot to an edge of the housing, the mounting leg extending from the edge for surface mounting to the LED circuit board.

7. The connector assembly of claim 1, further comprising a hold down tab held by the housing, the hold down tab configured to secure the housing to the LED circuit board.

8. The connector assembly of claim 1, wherein the housing includes a polarizing feature in the drive card slot, the polarizing feature orienting the driver card in the driver card slot.

9. The connector assembly of claim 1, further comprising a second contact channel and a second contact received in the second contact channel, the contact and the second contact extending beyond the inner wall into the driver card slot to mate with the drive card, the inner wall being stepped such that a greater length of the contact is exposed to the driver card slot than the second contact.

10. A connector system comprising:

an LED circuit board having a front side, a rear side and an opening extending therethrough, the LED circuit board having a mounting pad on the front side, the LED circuit board having at least one LED mounted on the front side;

a driver card having a power supply, the driver card having a power pad proximate to a mating edge of the driver card, the mating edge being stepped with a slant surface that is angled transverse to a loading direction of the driver card; and a connector assembly coupled to the LED circuit board and receiving the driver card to supply power from the driver card to the LED circuit board, the connector assembly comprising:

a housing having a body and a head extending outward from the body, the housing being coupled to the LED circuit board with the head mounted to the front side of the LED circuit board and with the body extending through the opening of the LED circuit board to the rear side of the LED circuit board, the housing having driver card slot in the body receiving the driver card therein in a loading direction from the rear side of the LED circuit board, the body having an open bottom opening to the driver card slot, the body having an inner wall opposite the open bottom and side walls that extend between the open bottom and the inner wall, and the housing having a contact channel extending through the head and being open to the driver card slot, the housing having an undercut in the inner wall defining a latch in the driver card slot remote from the open bottom, the undercut having a slant surface being angled transverse to the loading direction, the slant surface of the housing engaging the slant surface of the driver card to retain the driver card in the driver card slot; and a contact received in the contact channel, the contact having a mating interface configured to engage and be electrically connected to the power pad of the driver card, the contact having a mounting leg extending from the head and being terminated to the mounting pad on the front side of the LED circuit board.

11. The connector system of claim 10, wherein the driver card includes a second power pad proximate to the mating edge, the connector assembly including a second contact engaging a second power pad, wherein the power pad and the second power pad are staggered such that the contact engages the power pad prior to the second contact engaging the second power pad during loading of the driver card into the driver card slot.

12. The connector system of claim 10, further comprising a stop to limit insertion of the driver card into the driver card slot.

13. The connector system of claim 10, further comprising a heat sink, the LED circuit board being mounted to the heat sink, the body of the housing extending through the heat sink.

14. A connector assembly for mounting to a substrate having an opening extending between a front side and a rear side, the connector assembly comprising:

a housing having a body at a bottom of the housing and a head at a top of the housing, the head extending from the body, the head being wider than the body and being configured to be mounted to the front side of the substrate with the body extending through the opening of the substrate to the rear side of the substrate, the housing having a contact channel extending therethrough being open at the top and the bottom of the housing, the housing having an open bottom and an inner wall opposite the open bottom and side walls that extend between the open bottom and the inner wall, the housing having an undercut in the inner wall defining a latch remote from the open bottom, the undercut having a slant surface being angled transverse to the open bottom, the slant surface defining a latch configured to latchably secure a mating component against the inner wall; and a contact received in the contact channel, the contact having a mating interface configured to engage and be electrically connected to a power conductor of the mating component loaded into the housing in a loading direction through the open bottom of the housing from the rear side of the substrate, the contact having a mounting leg, the mounting leg extending from the head and configured to be mounted to the front side of the substrate.

15. The connector assembly of claim 14, wherein the contact includes a wire barrel defining the mating interface, the wire barrel being configured to conceive the power conductor, the contact having a spring finger extending into the wire barrel to engage the power conductor.

16. The connector assembly of claim 14, wherein the body includes a driver card slot at the bottom configured to receive a driver card having the power conductor thereon, the contact including a spring beam defining the mating interface, the spring beam defining a separable mating interface configured to engage the power conductor of the driver card.

17. The connector assembly of claim 1, further comprising a second contact channel and a second contact received in the second contact channel, the contact and the second contact extending beyond the inner wall into the driver card slot to mate with the driver card, the inner wall being stepped to define the undercut such that a first portion of the inner wall is a first depth from the driver card slot opening and such that a second portion of the inner wall is a second depth, different from the first depth, from the driver card slot opening.

18. The connector assembly of claim 1, wherein the slant surface is configured to engage a mating edge of the driver card to retain the driver card in the driver card slot.

19. The connector assembly of claim 1, wherein the contact extends from the contact channel beyond the inner wall such that the mating interface is located between the inner wall and the bottom opening.

20. The connector system of claim 10, wherein the contact extends from the contact channel beyond the inner wall such that the mating interface is located between the inner wall and the bottom opening.

* * * * *